United States Patent [19]

Pollmeier et al.

[11] 4,104,977

[45] Aug. 8, 1978

[54] FABRIC-FEED CONTROL FOR SEWING MACHINE

[75] Inventors: Konrad Pollmeier, Bielefeld; Franz Hannemann, Detmold, both of Fed. Rep. of Germany

[73] Assignee: Dürkoppwerke GmbH, Bielefeld, Fed. Rep. of Germany

[21] Appl. No.: 793,419

[22] Filed: May 3, 1977

[30] Foreign Application Priority Data

May 8, 1976 [DE] Fed. Rep. of Germany ..... 7614577

[51] Int. Cl.[2] ..... D05B 21/00

[52] U.S. Cl. ..... 112/121.26; 112/153; 112/148; 112/121.12

[58] Field of Search ..... 112/121.26, 121.15, 112/153, 203, 207, 148, 121.11, 121.12

[56] References Cited

U.S. PATENT DOCUMENTS 3,769,924 11/1973 Rogers et al. ..... 112/121.12 X 4,013,025 3/1977 Marforio ..... 112/121.26 X

FOREIGN PATENT DOCUMENTS 2,454,030 5/1976 Fed. Rep. of Germany ..... 112/121.26

*Primary Examiner*—Peter Nerbun

*Attorney, Agent, or Firm*—Karl F. Ross

[57] ABSTRACT

A sewing station in which lengthy material, e.g. sleeve or trouser-leg fabric workpieces, can be provided with a seam in substantially automated operation. The material to be sewn is advanced from a loading station, where it is initially held by a fixed clamp, to the sewing machine. While the material is advanced past the sewing machine by the fabric transport, it is guided by a moving or trailing clamp which trails along with the material holding it in lightly stretched relation to the sewing machine transport mechanism. The clamps are provided with pneumatic pistons which actuate or perform the clamping functions. The pistons are controlled by switches and valves to alternatingly open and close the clamps as required by the seaming operation. The station provides for a simplified operation requiring monitoring by an operator only for the initial positioning and initial seaming.

15 Claims, 6 Drawing Figures

FIG.1
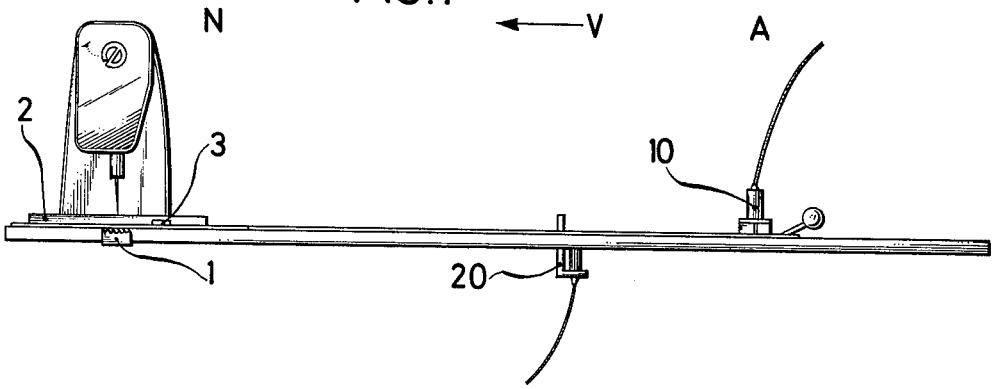
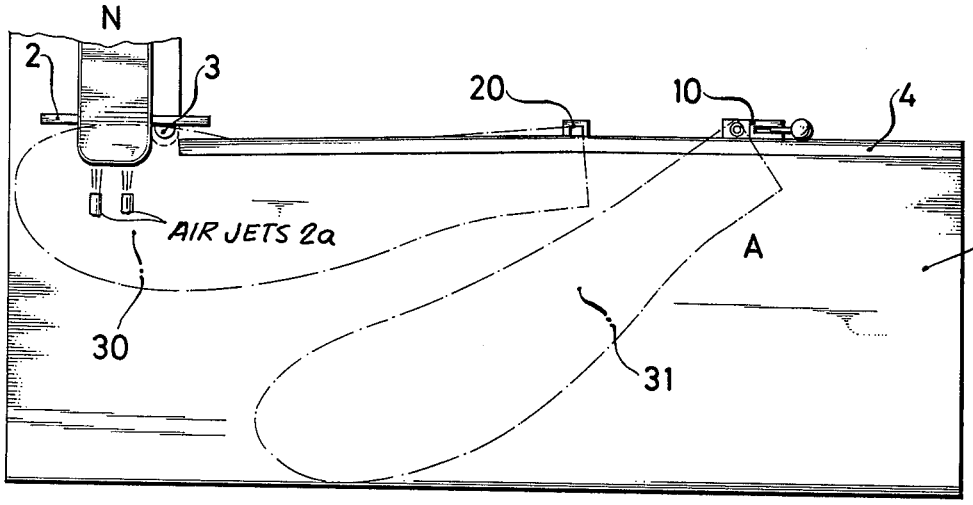
FIG. 2
FIG.4
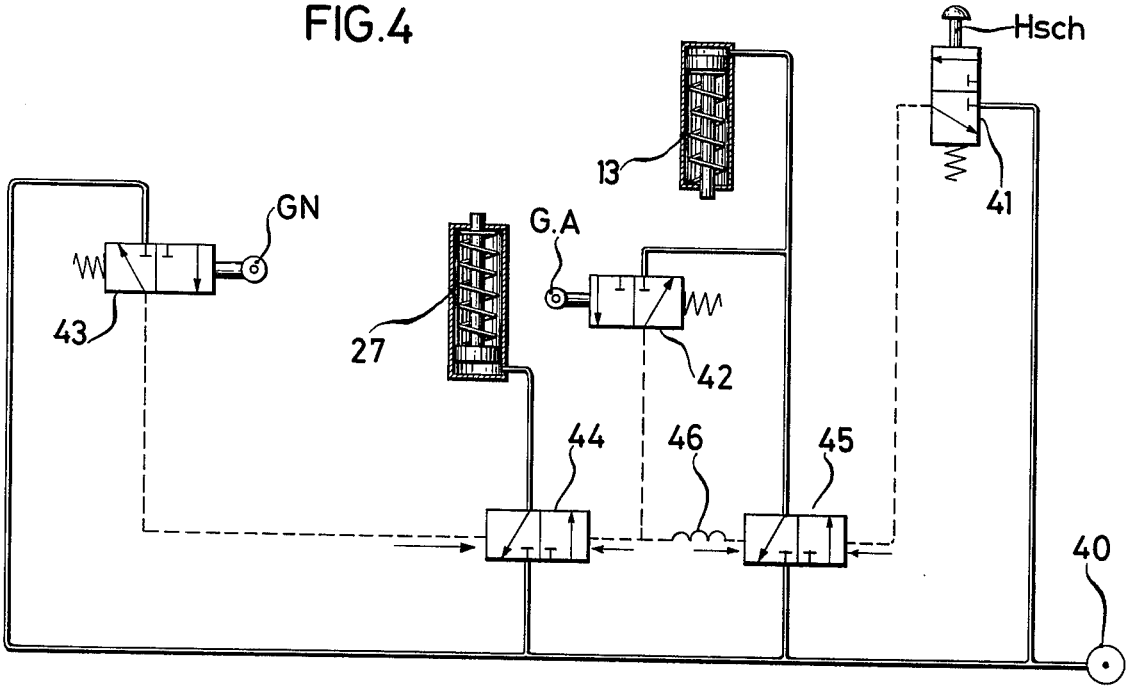

1
2
3
N
GN
21
22
211
212
284
282
281
213
283
285
29
20
214
271
27
28
251
26
V
25
14
13
11
12
10
GA
42
A
16
15
5
Hsch
4
41
24
24a
16
16a
16b
16c

FABRIC-FEED CONTROL FOR SEWING MACHINE

CROSS-REFERENCE TO RELATED APPLICATION

This application is related to our commonly assigned copending application Ser. No. 632,100 filed Nov. 14, 1975 now U.S. Pat. No. 4,062,309 issued Dec. 13, 1977.

FIELD OF THE INVENTION

The present invention relates to joining of textile pieces, for example sleeve or trouser-leg fabric workpieces, by a seaming operation of a sewing machine. More particularly, this invention is concerned with the positioning, retaining and advancing of material to be sewn in a sewing station.

BACKGROUND OF THE INVENTION

Sewing machines comprising auxiliary feed devices as briefly outlined in the foregoing are known in the art. They serve to achieve a nearly fully automated joining of textile material or the like to be sewn together. Such pieces can be sleeves, trouser-leg fabric workpieces or similar garment pieces.

In such arrangements care has to be taken to ensure proper advancing or transporting of the parts to be sewn together in the sewing machine with respect to the sewing machine. Thus, the parts have to be guided with relation to the needle or, in other words, in a position which will ensure formation of a desired stitch pattern or contour.

This is achieved by guide means which exert a self-guiding effect on the parts to be sewn, which avoid wandering in a sideway direction of the parts and which will attain stretching of the material by attaching the parts to movable carriers.

Sewing machines equipped with a relatively small number of feed and control devices, to form a sewing station as mentioned in the foregoing, normally require only one operator whose responsibility is restricted to ensuring the accurate positioning of parts at a loading station. While it would appear that a streamlined operation is thus achieved, the cyclic nature of the reciprocating motion, i.e. the advancing and retracting of the carrier to and from the sewing machine, has been an obstacle in achieving a truly efficient operation.

The drawback of the devices of the prior art becomes especially apparent when working with lengthy garment pieces. Thus, considerable down time will occur because of the intermittent operation of such systems.

In German utility model (Gebrauchsmuster) DGBM 7438034 it has been suggested, for example, to utilize two carriers or clamps in alternating fashion. In this proposal the down time is reduced or eliminated because one carrier is loaded and then moved into the working position with respect to the sewing machine while the second carrier is loaded and brought into position for advancement to the sewing machine.

Such an operation can be carried out with a single carrier when provision is made to arrange the parts to be sewn together in assemblies which can readily be sewn together on the sewing machine. This preparatory step is carried out while the carrier returns to the loading station. The assemblies to be sewn together by the sewing machine are then transferred to the carrier by means of a transfer device. During the transfer a short period of down time is incurred.

Also, the sewing facilities that are known in the art and offer a relatively continuous operation require numerous moving parts and thus tend to be expensive and difficult to operate.

OBJECTS OF THE INVENTION

It is therefore an object of the present invention to provide a sewing arrangement which will permit relatively continuous seaming operation.

It is also an object of the present invention to provide a fabric-feed control assembly which obviates the disadvantages of the earlier system and extends the principles of our above-identified copending application.

Another object is the provision of a sewing station having simple parts to transport pieces to be sewn together from a loading station to the sewing machine.

A further object of the invention is to provide, in combination with a sewing machine having a fabric-feed mechanism, improved means for controlling the advance of a fabric to the stitching location using only a single moving clamp.

A still further object of the present invention is the provision of a sewing station that is simple to operate.

SUMMARY OF THE INVENTION

In accordance with the present invention, a sewing station is provided which permits seaming operations to be carried out on a relatively continuous basis on relatively long garment pieces.

In accordance with one feature of the present invention, a sewing machine, provided with a fabric-transporting feed mechanism, guide means and self-adjusting positioning means as are known in the art, cooperates with a loading station, which loading station includes a fixed clamp to hold the material after it has been positioned by the operator. The purpose of this clamp is to hold the material in position until work on a preceding article has been completed.

The sewing machine also cooperates with a trailing or moving clamp which is temporarily attached to the material to be sewn so that it can hold and guide the material throughout the seaming operation.

In accordance with another feature of the invention, the fixed and the trailing clamp comprise pistons or cylinders which will perform or actuate to perform clamping actions. The pistons of the clamps are controlled by a control circuit which comprises control valves for the control of a pneumatic force such as compressed air. The control valves, in turn, are actuated by switches so that the fixed clamp and the trailing clamp open and close in alternating fashion.

In yet another feature of the invention, the fixed clamp is only opened upon positive clamping of the material by the moving or trailing clamp.

In still another feature of the invention, the distance of the fixed clamp with respect to the sewing machine can be varied as required by various lengths of material to be sewn.

In a further feature of the invention, the moving clamp forms part of a runner, guided on a guide channel disposed between the sewing machine and the loading station.

In yet another feature of the present invention, the moving clamp is retracted from the sewing machine towards the fixed clamp or the loading station by a counterweight attached to said trailing or moving clamp.

BRIEF DESCRIPTION OF THE DRAWING

The above and other objects, features and advantages will become apparent from the following description, reference being made to the accompanying somewhat fragmentary drawing in which:

FIG. 1 is a side elevation of a sewing station in accordance with the present invention;

FIG. 2 is a plan view of the sewing station with a phantom outline of the movement of material to be sewn;

FIG. 4 is a diagram of the control circuit of the pneumatic system for the sewing station.

SPECIFIC DESCRIPTION

Figures 3, 3A, 3B:
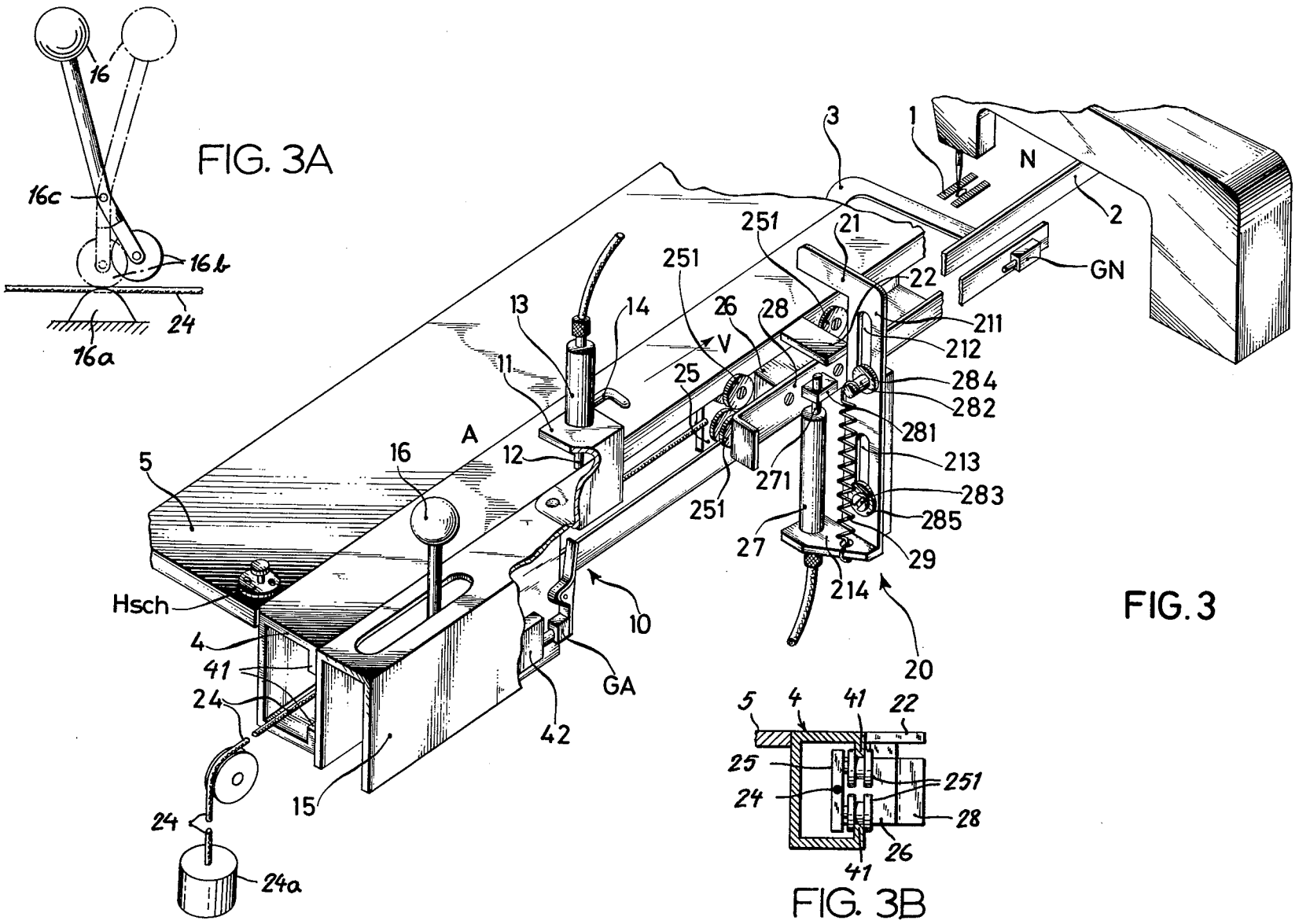
FIG. 3 is a perspective view of a sewing station showing in greater detail a moving clamp and a fixed clamp and the associated control and guide features.
FIG. 3A is a diagram illustrating operation of a roller clamp according to the invention.
FIG. 3B is a section through the guide rail showing a portion of the trailing (movable) clamp in elevation.

As can best be seen in FIGS. 1 and 3, a sewing machine is provided, for example, a high-speed industrial sewing machine designated by the letter N. The sewing machine comprises a transport means such as a feed system composed of a pressure foot and feed dog, which latter component is shown and designated by numeral 1. The feed system serves to advance the material of which two pieces are shown, designated by the numerals 30 and 31, as can be seen in FIG. 2. The individual pieces of material are initially held in a fixed clamp 10, to be described in greater detail below, and are then advanced from a loading position, designated A, in the direction of arrow V towards the sewing machine N. While traveling towards the sewing machine the material is supported by a support table or surface 5 and the travel is guided or controlled by a trailing clamp 20 as will be described in greater detail below.

Sewing machine N is also provided with an edge guide for material to be sewn, which edge guide is comprised of a lateral guide bar 2 arranged in the direction of the movement of the material to be sewn and separator plates 3 extending perpendicularly with respect to guide bar 2. Plates 3 serve to briefly separate the parts of material to be sewn together and thus permit the parts to individually align themselves against the guide bar 2, which parts were positioned at the loading station A. Means are also provided, not shown in greater detail, for example, air-jet nozzles 2a advancing the material against guide bar 2. Thus, it is possible to sew together in the sewing machine N material the individual parts of which are not originally coextensive over their entire areas.

The material traverses under the arm of the sewing machine N while a seam is formed to provide a seaming operation which is continuous and does not require manual adjustment by an operator.

Moving or trailing clamp 20 is guided in a guide channel 4. This clamp is attached to the rearward edges, rearward with respect to the direction of arrow V, of material to be sewn, i.e. 30 and 31 as shown in FIG. 2.

In the embodiment of the trailing clamp 20 as shown in greater detail in FIG. 3, the clamp comprises a pair of clamping jaws 21 and 22, of which jaw 22 is movably arranged with respect to fixed jaw 21. Trailing clamp 20 is in its entirety movably disposed in and on guide channel 4.

Trailing clamp 20 is retractable into the loading position A by means of a counterweight **24*a*, not shown in detail, attached to the free end of rope or cable 24 in channel 4 while the other end of rope or cable 24 is secured, either in a hole or on a hook of a runner plate 25** which will be further described below. Such counterweight arrangements are known in the art. They serve to ensure that the material to be sewn will be held sufficiently taut while a seam is formed, i.e. while the material is advanced.

Upon completion of the seaming operation, the trailing clamp 20 releases the material and the potential energy stored by the counterweight **24*a*** will cause the retraction of the trailing clamp to position A.

As can best be seen in FIG. 3, trailing clamp 20 comprises a runner plate 25, disposed in the channel 4, which runner plate 25 carries near its respective ends two pairs of superimposed rollers designated 251, the last roller not being visible. The four rollers 251 are provided with grooves which communicate with the guide channel 4.

The runner plate 25 is free to move on the runner bars 41 of guide channel 4 in a direction parallel to the direction of the guide channel. The guide channel 4 is fixed against the support table or surface 5 by fasteners, not shown in detail. Thus, the upper horizontal arm of C-shaped channel 4 is flush with the top of support surface 5.

A spacer 26 is located between the rollers 251 in the central part of runner plate 25, which spaces is connected, for example, with threaded fasteners, to a mounting or support strip 28. The end directed towards sewing machine N of strip 28 receives the lower fixed jaw of the trailing clamp 20. Thus, the height of the strip is sufficient to provide a support for jaw 22 so that the top surface of this jaw is flush with the upper horizontal arm of guide channel 4 which, in turn, is flush with the support surface 5 as described earlier. Jaw 22 can be a simple rectangular piece of sheet metal or the like which extends perpendicularly with respect to guide channel 4. The support end of strip 28 for jaw 22 is further extended downwardly than the remainder of the strip in order to provide an anvil for the moving jaw 21 of the trailing clamp.

Jaw 21 is movably mounted by means of a pair of guide means as will be described in greater detail below. The jaw is moved by a pneumatic piston 27. Moving jaw 21 comprises a longitudinal base portion 211 having slots 212 and 213. At its lower end it provides a footing 214 for the pneumatic piston 27. The piston is attached, via its piston rod end 271, to a retaining block 281 which block is attached to the mounting strip 28, for example by welding. The moving jaw 21 is also made of simple structural components which can be produced by cutting of sheet metal and which are easily assembled by welding. Thus, the upper clamping end of moving jaw 21 will either be of the width of the material used or will be provided with a cross-member to provide a larger clamping area.

The moving jaw 21 is made movable by providing guide pins 282 and 283, mounted with threaded ends in correspondingly threaded holes in the downwardly extending portion of the support strip 28. The threaded length of both pins is such that it will connect the pins with the threaded holes in the downwardly extending portion of support strip 28. The remaining ends of the two pins, protruding through the base portion 211, i.e. the longitudinal slots 212 and 213, have a diameter which permits sliding motion of the base portion 211 with respect to the pins 282 and 283.

The upper pin 282 comprises a retaining groove at its outwardly extending end to receive a compression spring 29 which is attached with its other end to the footing 214. Lower pin 283 can be a conventional screw with a slotted head. Both pins carry cover discs or washers 284 and 285 which have an outer diameter which ensures retention of the base portion when performing a sliding motion on the downwardly extending end of strip 28.

Thus, moving jaw 21 may be displaced, in a vertical direction, downwardly into a clamping position and upwardly into a nonclamping or rest position, which rest position is indicated by the position of the upper jaw 21 of moving clamp 20 in FIG. 3. Accordingly, the length of the slots 212 and 213 must be sufficient to permit this movement.

The clamping position of moving jaw 21 with respect to support or fixed jaw 22 is attained by actuating pneumatic piston 27. Piston 27 is vertically mounted in an opening in footing 214 which footing is provided with a horizontal portion either integrally shaped with the base or attached to the base 211 of moving jaw 21.

In general, all components such as the mounting strip 28, the support base portion and other components can be formed of sheet metal which is cut to size as required, with smaller pieces being attached, for example, by welding.

As indicated previously, the piston rod 271 of pneumatic piston 27 is attached to the support strip 28 by means of retaining block 281. As is indicated in FIG. 3, the piston rod is not extended, i.e. there is no pressure on the rod to actuate the moving clamp and thus the clamp is in rest or open position with respect to its jaws 21 and 22.

When the pneumatic piston is pressurized, by control means yet to be described, piston rod 271 is driven downwardly and moves the base portion 211 of moving jaw 21 also in a downward direction, resulting in closure of the clamp 20 as jaws 21 and 22 come into clamping distance with respect to each other. As has been explained earlier, the downward motion of the base 211 is guided by pins 282 and 283 and the retaining washers 284 and 285. As the base portion 211 travels in downward direction, the compression spring 29 is expanded, providing a force for the return of the moving jaw into its rest position.

Thus, as the piston is pressurized, the clamp 20 is closed and the clamp 20 is opened by the action of the compression spring upon termination of the pressurization of piston 27.

The trailing or moving clamp thus far described in some detail cooperates with a fixed clamp or edge holding clamp 10. While the trailing clamp 20 can move freely along its path with respect to guide channel 4, the fixed clamp serves only briefly to hold material to be worked on. Thus, fixed clamp 10 is somewhat less complex and does not require special jaws as does clamp 20.

Fixed clamp 10 comprises a U-shaped holding bracket 11 shown in FIG. 3 with a cut-out to permit viewing of the clamping tool of this clamp. The clamping tool is a pneumatic piston 13 arranged in vertical fashion to provide for a downward stroke of the piston rod 12. The piston rod 12 engages with the material to be sewn in clamping relation.

The u-shaped bracket is mounted on the upper arm of the guide channel 4 such that the lower toe provides a surface, with the top of channel 4 and the support surface 5, on which the material to be sewn will rest smoothly. Thus, as the piston 13 is pressurized, its rod 12 will be extended and hold the material to be worked on.

Holding bracket 11 is provided with a finger guard 14 to prevent accidental reach into the path of the extending piston rod 12.

Fixed clamp 10 is part of a guide holder 15 which is arranged adjustably with respect to the sewing machine N so that the distance of the fixed clamp or loading station A with respect to the sewing machine N can be varied in accordance with the length of the material that is to be sewn. This can best be seen in FIGS. 1 and 2.

Also, the free movement of the moving or trailing clamp 20 is limited by guide holder 15 which can be adjusted in its relative position with respect to the sewing machine N by means of a coupling such as, for example, a roller clamp actuated by handle 16 (FIG. 3A). As will be apparent from FIG. 3A, the rope or cable 24 can pass over a guide **16*a* against which it can be pressed, to hold the cable in place, by a roller 16*b* on the end of an arm affixed to handle 16 and fulcrumed on the holder 15 at 16*c***.

As can be seen in FIG. 3, a sensor (limit) switch or a valve actuator GA, attached to guide holder 15, is connected with or directly operates a pneumatic valve 42 the function of which will be described in more detail below. Another limit switch (or valve actuator) GN is located in the path of trailing clamp 20 in the vicinity of the sewing machine N. A main control switch or valve actuator Hsch is provided for the operator while the sensor switch and limit switch are actuated by the trailing clamp 20, i.e. the mounting strip 28 whose end, extending in the direction of loading station A, is provided with a bumper portion as can best be seen in FIG. 3 to actuate the sensor switch GA.

The control switches just referred to are parts of a control system for actuating the pneumatic pistons 13 and 27 on the fixed clamp 10 and trailing clamp 20, respectively.

As is shown schematically in FIG. 4, pistons 13 and 27 are actuated alternatingly. Actuation of the pistons is effected when the trailing clamp is resting against the guide holder 15, i.e. is positioned near loading station A and when the trailing clamp 20 is in the vicinity of the sewing machine N when the trailing clamp will open to release the material.

Five pneumatic valves, 41, 42, 43, 44 and 45, are provided in the control circuit. These are of known construction to provide for either "fully open" or "fully closed" control. Valve 41 is controlled by the operator by means of the main control switch Hsch while valves 42 and 43 are actuated by means of switches GN and GA. These switches, in turn, are actuated by the trailing clamp 20, depending on its relative position on the guide channel 4. Thus, when the trailing clamp is near the sewing machine N, switch GN will be actuated and switch GA will be actuated when the trailing clamp is near the loading station A.

A pneumatic supply source providing, for example, compressed air, is indicated by numeral 40.

When the main control switch Hsch is depressed, i.e. the circuit it controls is closed, valve 41 is switched to the open position. Valve 45, responsive to the air pressure, is opened as well and thus piston 13 is actuated so that the piston rod 12 is extended downwardly to hold material to be sewn.

Upon return of the trailing clamp 20 to the loading station A, sensor switch GA is actuated. Thus, valve 42 is opened which, in turn, reverses the control functions of valves 44 and 45. Valve 45 is closed as will be described later. Valve 44 is opened and actuates piston 27 to close the trailing clamp 20. A restriction or throttle 46 will serve to delay closing of the valve 45 until the fixed clamp is positively closed before the piston rod 12 releases the material. When the trailing clamp 20 actuates the limit switch in the vicinity of sewing machine N, valve 43 is opened which will cause valve 44 to close. This means that the compression spring 29 can act to open the clamp so that the trailing clamp will return to the loading position in open position, due to the pull exerted by the counterweight on rope 24.

The invention will now be further described by outlining the complete cycle of operation including all parts of the sewing station.

As shown in FIG. 2, an article 30 is still being sewn in the sewing machine N. At loading station A, the operator can, however, position another article 31, for example an upper and lower sleeve, by placing the individual parts, as is known in the art, on top of each other so that they are positioned for correct location of the seam to be produced by the sewing machine and with the edges extending in the desired feed direction.

Following positioning of article 31 on support surfaces 5, main control switch Hsch is actuated whereby the fixed clamp is actuated and piston rod 12 is moved down into clamping position on article 31. Thus the article 31 is positioned and secured.

Upon completion of the sewing operation on article 30, followed by stacking thereof as is known in the art, trailing clamp 20 actuates the sensor switch GA and thereby the piston 13 of the fixed clamp 10 as well as piston 27 of the trailing clamp 20. As described earlier, opening of the clamp 10 is delayed until clamp 20 is positively in clamping position.

The operator now positions the forward end of article 31 at the guide 2, while lightly stretching the same, until the sewing machine has completed the first few stitches of the seam to be made. The operator then releases the material and the sewing station completes the seam while the operator prepares a further supply of material at loading station A.

When the trailing clamp, which trails with article 31, actuates the limit switch GN, the clamp releases the article and the clamp returns to the loading station A as described.

Thus, as described in the foregoing, a sewing station is provided in which the material is positioned by the operator and held at the loading station by the fixed clamp. As the trailing clamp returns from the preceding operation, it engages the material to be sewn in clamping position next to the fixed clamp. Once the trailing clamp is positively closed, the fixed clamp releases the material and the material moves along in its path, begun by the operator for a few stitches, under the sewing machine. The material is guided and held lightly stretched by the trailing clamp. The guiding is also ensured by air jets or like means as well as positive guide means such as guide bars. Upon completion of the seaming operation, the trailing clamp actuates the limit switch which will cause the trailing clamp to open and release the material. The trailing clamp is then returned to the loading station as described.

We claim:

1. A sewing station for seaming of material, comprising in combination:

a table;

a sewing machine having a transporting feed mechanism for advancing fabric to be sewn on said table past a needle;

an edge guide spaced from said needle on said table for automatic guiding of the fabric for advancement with its edge along said guide while the seaming operation is carried out;

separating plates ahead of said edge guide for separating layers of the fabric;

a movable clamp actuatable to grip the fabric for advancing with the fabric to be seamed, said movable clamp being guided linearly on said table toward and away from said needles;

a fixed clamp on said table remote from said needle for preparatory positioning and holding of the fabric; and control means for alternately actuating said fixed clamp and said movable clamp to respectively grip and release the fabric.

2. The sewing station defined in claim 1 wherein each of said clamps is provided with a respective pneumatic cylinder, said control means including respective valves alternately actuating said cylinders to close one of said clamps and open the other of said clamps.

3. The sewing station defined in claim 2 wherein said control means further includes limit means along the path of said movable clamp and operated thereby for reversing said valves.

4. In a sewing station as defined in claim 1, a first piston associated with the movable clamp;

a second piston associated with said fixed clamp; and control means for alternatingly actuating said first piston and said second piston.

5. A sewing station as defined in claim 4 wherein said two pistons are actuated independently of each other.

6. A sewing station as claimed in claim 4, further comprising:

a sensor switch associated with said fixed clamp;

a limit switch arranged in the path of said moving clamp in the vicinity of said sewing machine; and a plurality of valve means for controlling a pneumatic supply source whereby said sensor switch and said limit switch are actuated by said movable clamp.

7. A sewing station in accordance with claim 11, wherein at least one pneumatic valve is associated with said first piston and at least one pneumatic valve is associated with said second piston, further comprising a throttle for delayed closing of said pneumatic valve associated with said first piston such that the fixed clamp will be opened only upon positive closure of the movable clamp.

8. A sewing station in accordance with claim 7, wherein a main control switch is provided for actuating said piston of said fixed clamp.

9. A sewing station for seaming of material, which comprises:

a sewing machine having a transporting feed mechanism and guides for guiding the material to be sewn during formation of a seam;

a loading station arranged at the feed side of the sewing machine at a predetermined distance;

a support surface extending between said sewing machine and said loading station;

a guide channel abutted to said support surface to provide a continuous support area with said support surface;

a runner disposed in said guide channel comprising a runner plate and at least two pairs of rollers for moving said runner in said guide channel in reciprocating motion between said loading station and the sewing machine;

a clamp attached to said runner forming a moving clamp;

a second clamp attached to said guide channel near the loading station forming a fixed clamp; and actuating means for alternatingly opening and closing said fixed and said moving clamp.

10. A sewing station as defined in claim 4, wherein said moving clamp comprises:

a fixed jaw;

a movable jaw; and a piston for actuating said movable jaw with respect to said fixed jaw to close said movable clamp.

11. A sewing station as defined in claim 10 wherein said fixed jaw and said movable jaw are maintained in frictional cooperation by a pair of slots in said movable jaw and retaining washers mounted on guide pins on a downwardly extending backup arm of said runner.

12. A sewing station as defined in claim 10 wherein said movable jaw is returned to its rest position by a compression spring.

13. A sewing station as defined in claim 9 wherein said fixed clamp is positioned adjacent to said loading station and comprises:

a holding bracket which provides a base to hold the material at the same height as said support surface and said guide channel; and a piston having a piston rod for clamping of the material on said base.

14. A sewing station as claimed in claim 4 wherein the distance of the fixed clamp with respect to the sewing machine is adjustable.

15. A sewing station as claimed in claim 4 wherein air jets are provided for urging the material to be sewn against said guides.

* * * * *